US008059004B2

(12) United States Patent
James et al.

(10) Patent No.: US 8,059,004 B2
(45) Date of Patent: Nov. 15, 2011

(54) DRAIN BLOCKAGE RESPONSIVE ALARM SYSTEM

(76) Inventors: Eric James, Seaford, DE (US); Laura James, Seaford, DE (US)

( * ) Notice: Subject to any disclaimer, the term of this patent is extended or adjusted under 35 U.S.C. 154(b) by 372 days.

(21) Appl. No.: 12/349,964

(22) Filed: Jan. 7, 2009

(65) Prior Publication Data

US 2010/0171623 A1 Jul. 8, 2010

(51) Int. Cl.
*G08B 21/00* (2006.01)

(52) U.S. Cl. ..... 340/608; 340/607

(58) Field of Classification Search ..... 340/607, 340/608; 210/85, 86, 87, 90; 137/557, 558
See application file for complete search history.

(56) References Cited

U.S. PATENT DOCUMENTS 2,761,037 A * 8/1956 Thomas et al. ..... 200/83 S
2,985,187 A 5/1961 Hamilton
3,757,316 A * 9/1973 Fiorenzo ..... 340/608
3,774,187 A * 11/1973 Windham ..... 340/608
4,546,346 A 10/1985 Wave
4,922,234 A * 5/1990 Murphy ..... 340/608
4,961,068 A * 10/1990 Hendricksen ..... 340/616
4,973,950 A 11/1990 Tourtillott
5,006,833 A * 4/1991 Marlowe et al. ..... 340/611
5,687,761 A * 11/1997 Langes ..... 137/558
5,699,049 A * 12/1997 Difiore ..... 340/618
5,973,591 A * 10/1999 Schwartz et al. ..... 340/384.7

* cited by examiner

*Primary Examiner* — Jennifer Mehmood
(74) *Attorney, Agent, or Firm* — Jerry Haynes; Law Office of Jerry D. Haynes, P.A.

(57) ABSTRACT

Disclosed is a drain blockage responsive alarm system. The drain blockage responsive alarm system comprises a cleanout cap member, at least one drain blockage responsive element, and an alarming module. The cleanout cap member is capable of being installed at a portion of a drain pipe. Further, the at least one drain blockage responsive element is configured to the cleanout cap member adapted to sense clog deposition at the portion of the drain pipe, and to generate an output signal upon sensing the clog deposition. Furthermore, the alarming module is electrically coupled to the at least one drain blockage responsive element for generating an alarm signal upon receiving the output signal.

8 Claims, 3 Drawing Sheets

DRAIN BLOCKAGE RESPONSIVE ALARM SYSTEM

FIELD OF THE INVENTION

The present invention relates to sewerdrains and drainage systems, and more particularly, to a drain blockage responsive alarm system for giving an early warning regarding any blockage condition in a sewerdrain or drainage system of a residential and/or a commercial building to an inhabitant thereof.

BACKGROUND OF THE INVENTION

Maintenance of sewerdrainage systems (hereinafter also referred to as "drains") of residential and/or commercial buildings is an essential requirement for inhabitants thereof. Typically, the inhabitants of the residential and/or the commercial buildings are rarely aware of importance of maintenance of such sewerdrainage. However, upon a blockage condition in the drain, normal activities in the residential and/or the commercial buildings virtually cease until the blockage condition is rectified. Specifically, the inhabitants are not aware of the blockage condition in the sewerdrainage until the sewerdrainage begins to overflow.

In light of the above, various apparatuses have been made, which in one way or another, signal the inhabitants about the blockage condition in the sewer drainage. However, such apparatuses have been less than satisfactory in performance thereof, as such apparatuses only provide warning upon detecting the blockage condition in the sewerdrainage. Such warning may not be useful, as the warning will issue only after a blockage condition has already occurred in the sewerdrainage system.

Further, such apparatuses are complex and expensive, and, more importantly, installation techniques associated therewith are usually complicated. For example, many of such apparatuses necessitate installation thereof in the sewerdrainage system by skilled plumbers and/or electricians or other artisans. As a result, an average inhabitant or property owner, rather than making a large investment, may accept the risks that might occur from not installing such apparatuses.

In accordance with the foregoing, there exists a need for a drain blockage responsive alarm system of simple, dependable, and economical design. Specifically, there exists a need for a drain blockage responsive alarm system that may provide an advance warning under incipient blockage conditions of a sewerdrainage system to inhabitants of a residential and/or a commercial building, before an acute stage of blockage condition occurs in the sewerdrain. Further, there exists a need of a drain blockage responsive alarm system which may be readily installed by the inhabitants of the residential and/or the commercial building, without requiring any professional help and without requiring modification to the existing sewerdrain.

SUMMARY OF THE INVENTION

In view of the foregoing disadvantages inherent in the prior art, the general purpose of the present invention is to provide a drain blockage responsive alarm system that is configured to include all advantages of the prior art, and to overcome the drawbacks inherent in the prior art.

An object of the present invention is to provide a drain blockage responsive alarm system that may be readily installed in an interior drain pipe system of an existing sewerdrainage of a residential and/or a commercial building for providing advance warning about incipient blockage condition of the sewerdrainage to inhabitants of the residential and/or the commercial building.

Another object of the present invention is to provide a drain blockage responsive alarm system that may be readily installed by inhabitants of a residential and/or a commercial building, without modification of existing sewerdrainage systems.

To achieve the above objects, in an aspect of the present invention, a drain blockage responsive alarm system is provided. The drain blockage responsive alarm system comprises a cleanout cap member, at least one drain blockage responsive element, and an alarming module. The cleanout cap member is capable of being installed at a portion of a drain pipe. Further, the at least one drain blockage responsive element is configured to the cleanout cap member, adapted to sense clog deposition at the portion of the drain pipe, and to generate an output signal upon sensing the clog deposition. Furthermore, the alarming module is electrically coupled to the at least one drain blockage responsive element for generating an alarm signal upon receiving the output signal.

This together with the other aspects of the present invention, along with the various features of novelty that characterized the present invention, is pointed out with particularity in the claims annexed hereto and forms a part of the present invention. For a better understanding of the present invention, its operating advantages, and the specified object attained by its uses, reference should be made to the accompanying drawings and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawing, wherein like elements are identified with like symbols, and in which:

Like reference numerals refer to like parts throughout the description of several views of the drawings.

DETAILED DESCRIPTION OF THE INVENTION

For a thorough understanding of the present invention, reference is to be made to the following detailed description, including the appended claims, in connection with the above-described drawings. Although the present invention is described in connection with exemplary embodiments, the present invention is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "coupled," "connect," and variations thereof herein are used broadly and encompass direct and indirect couplings. The term "bottom," "outer," and the like, herein do not denote any order, elevation or importance, but rather are used to distinguish placement of one element over another. Further, the terms "a" and "an" herein do not denote a limitation of quantity, but rather denote the presence of at least one of the referenced item.

The present invention provides a drain blockage responsive alarm system that may be readily installed in interior piping systems of existing sewerdrainages of a residential and/or a commercial building. Specifically, the drain blockage responsive alarm system provides an advance warning under incipient blockage conditions of the sewerdrain to inhabitants of the residential and/or the commercial building, thereby preventing an acute stage of blockage condition in the sewerdrain. The drain blockage responsive alarm system is self-contained, and is capable of being easily installed by the inhabitants of the residential and/or the commercial building, without requiring any professional help and without requiring modification of existing sewerdrainage or sewer line.

Figure 1:
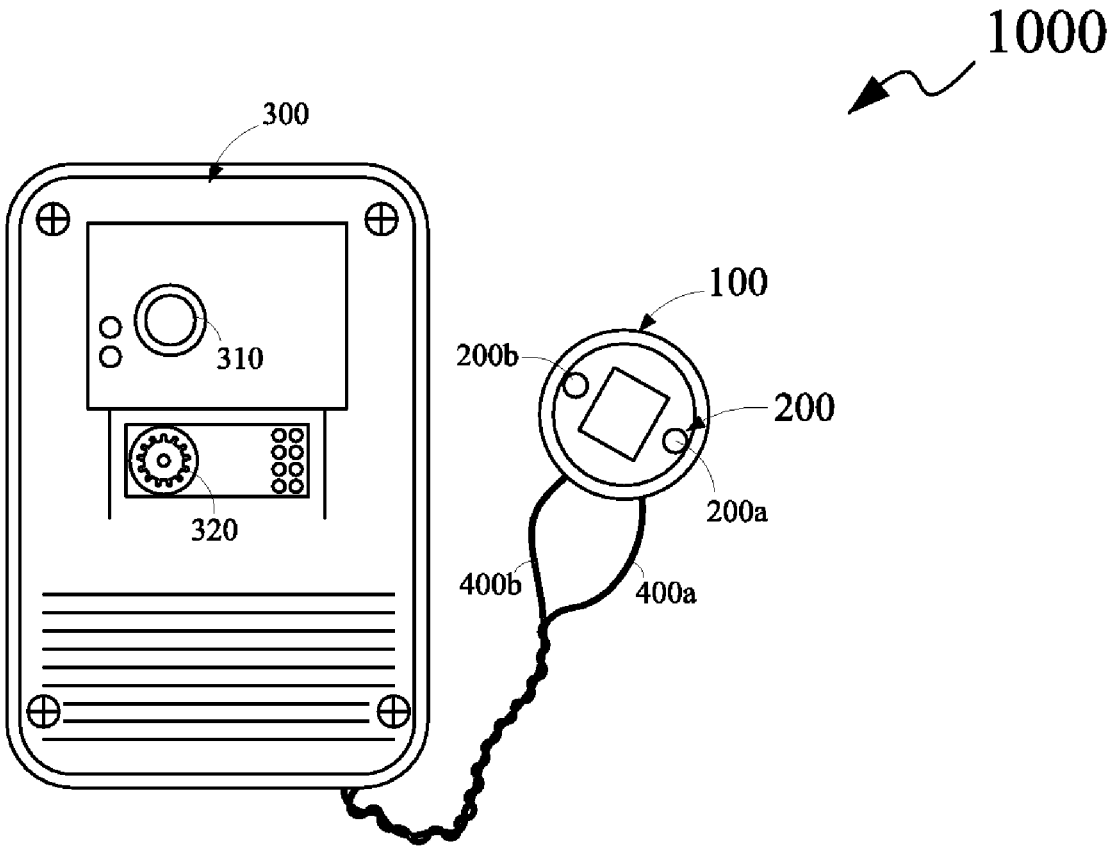
FIG. 1 illustrates a front view of a drain blockage responsive alarm system, according to an exemplary embodiment of the present invention.
Figure 2A:
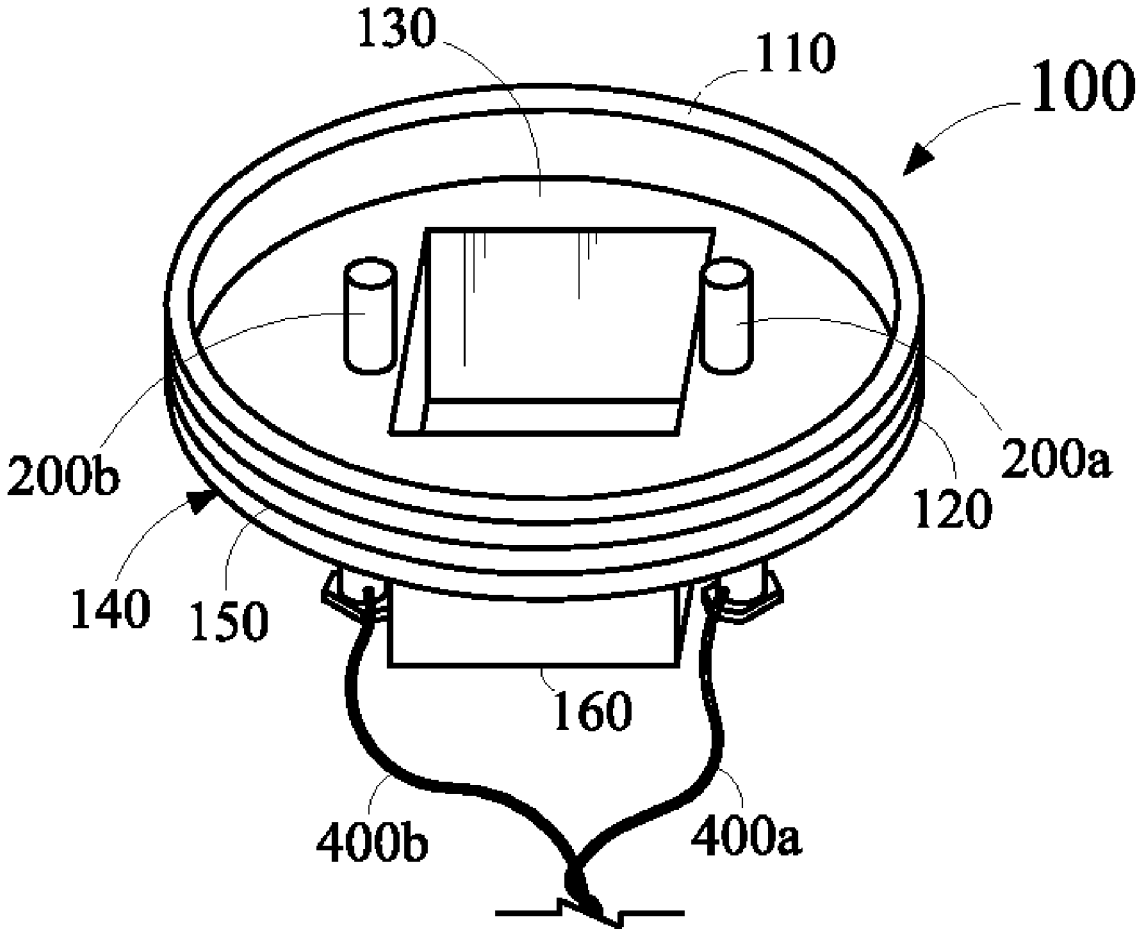
FIG. 2A illustrates a perspective front view of a cleanout cap member of the drain blockage responsive alarm system of the FIG. 1.
Figure 2B:
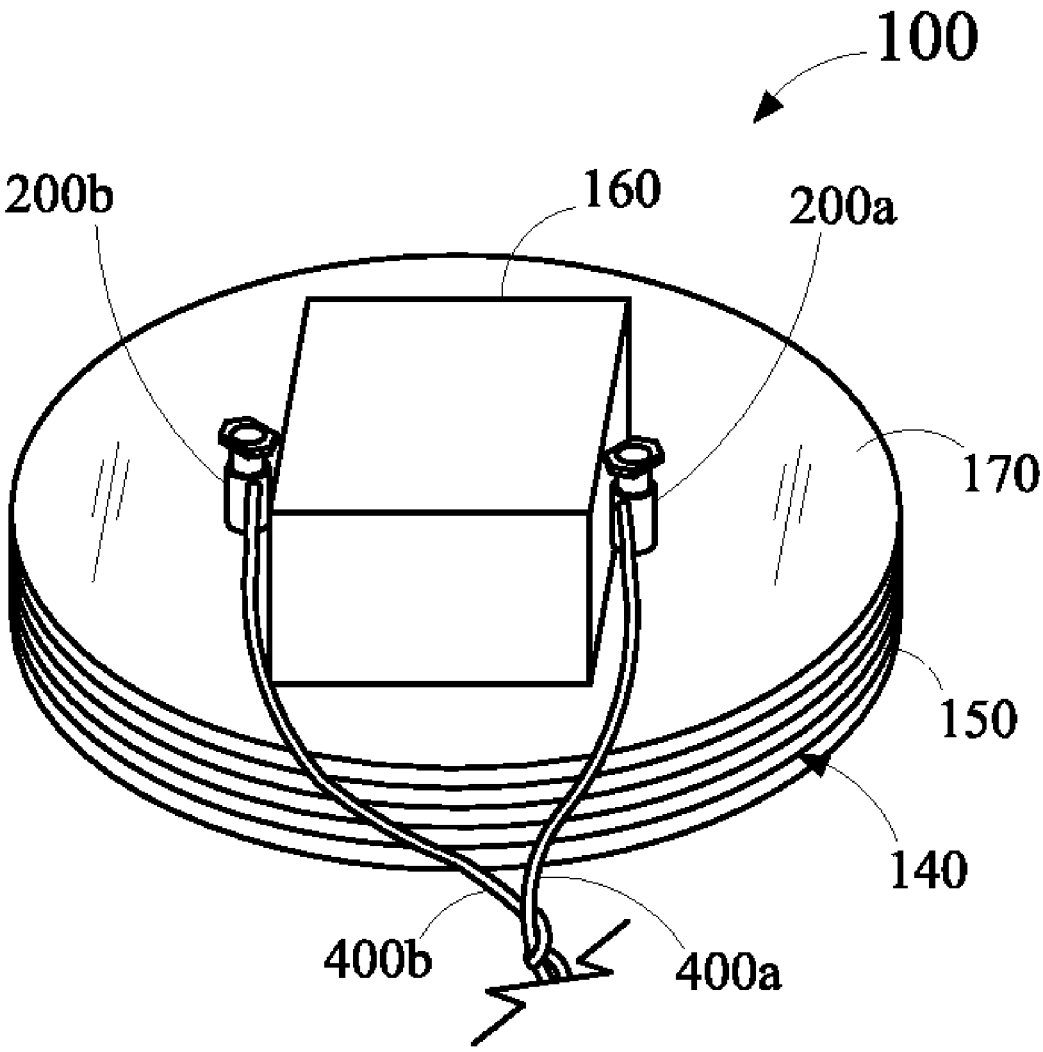
FIG. 2B illustrates a perspective back view of the cleanout cap member of the drain blockage responsive alarm system of FIG. 1.

Referring now to FIGS. 1 to 2B, several views of a drain blockage responsive alarm system 1000 (hereinafter referred to as 'alarm system 1000'), and components associated with the alarm system 1000 are illustrated, according to an exemplary embodiment of the present invention. More particularly, FIG. 1 illustrates a front view of the alarm system 1000. Further, FIG. 2A illustrates a perspective front view of a cleanout cap member of the alarm system 1000 of the FIG. 1; and FIG. 2B illustrates a perspective back view of the cleanout cap member of the alarm system 1000 of FIG. 1.

Referring particularly to FIG. 1, the alarm system 1000 comprises a cleanout cap member 100 (hereinafter referred to as 'cleanout cap 100'), at least one drain blockage responsive element 200, and an alarming module 300. The at least one drain blockage responsive element 200 is configured to the cleanout cap 100, and the alarming module 300 is electrically coupled to the at least one drain blockage responsive element 200. The cleanout cap 100 is capable of being installed at a portion of a drain pipe (not shown), specifically, to a portion of a drain pipe associated with a sewerline or a sewer drainage of a residential and/or a commercial building, where plumbers or inhabitants of the residential and/or the commercial building may access an interior of the sewerline without cutting the sewerline. More particularly, the cleanout cap 100 is placed at usages points, such as bathrooms, kitchens and laundries, and to an interior of dwelling like a tab and a shower floor drain. Further, the cleanout cap 100, under a normal condition of the sever line, is not in contact with water flow of the drain pipe of the sewerline. The drain pipe associated with the sewerline or the sewerdrainage of the residential and/or the commercial building is hereinafter referred to as 'interior drain pipe'. However, it will be evident to a person skilled in the art to secure the cleanout cap 100 to other drain pipes, such as a city sewerdrain pipe, a septic tank drain pipe, and the like. Further, the at least one drain blockage responsive element 200 is capable of sensing clog deposition in the interior drain pipe. Such clog deposition may include paper such as toilet paper, sanitary products such as sanitary napkins, hair strands, and the like. The alarming module 300 generates an alarm signal when the at least one drain blockage responsive element 200 senses the clog deposition at a beginning stage, before any back's up in the interior drain pipe occurs. The alarming module 300 makes the inhabitants of the residential and/or the commercial building aware of a possibility of a blockage condition in the interior drain pipe, thereby preventing an acute stage of blockage condition occurring in the interior drain pipe.

For the purpose of representation, in FIGS. 1, 2A and 2B, the at least one drain blockage responsive element 200 is shown to include two drain blockage responsive elements 200*a* and 200*b*. The two drain blockage responsive elements 200*a* and 200*b* hereinafter will be referred to as 'responsive elements 200*a* and 200*b*'.

As shown in FIGS. 1, 2A and 2B, the cleanout cap 100, is a one piece unit formed by a durable material or a combination of materials that may withstand environment within the sewerdrainage. According to one embodiment of the present invention, the cleanout cap 100 may be formed by molding plastics, such as PVC (Poly-Vinyl-Chloride) plastic, ABS (Aciryalonitrile-Butadien-Styrene, and the like. According to another embodiment of the present invention, the cleanout cap 100 may be formed of any other material, such as metal, any other types of plastics or combination thereof. The cleanout cap 100 is capable of being installed at a portion, such as a conventional opening, of the interior drain pipe of the sewerdrainage.

According to one embodiment of the present invention, the cleanout cap 100 is circular shaped having a diameter, generally, smaller than a diameter of the conventional opening of the interior drain pipe. The cleanout cap 100 includes a circular protrusion 110 extending from a periphery 120 thereof, defining a circular space 130. Further, the circular protrusion 110 along an outer periphery 140 thereof includes threads 150 adapted to mate with corresponding threads formed in the conventional opening of the interior drain pipe. Accordingly, the cleanout cap 100 is installed at the interior drain pipe. In a typical instance, the cleanout cap 100 having the threads 150 may be adapted to be installed on a standard 3 inches interior drain pipe. However, it will be evident to a person skilled in the art to configure the cleanout cap 100 with a different diameter, according to the requirement.

Referring particularly to FIG. 2B, according to another embodiment of the present invention, the cleanout cap 100 includes a rectangular protrusion 160 extending from a bottom portion 170 thereof. The rectangular protrusion 160 facilitates a user to install and uninstall the cleanout cap 100 at the interior drain pipe of the sewerdrainage. More particularly, the user may mate the threads 150 with the corresponding threads of the conventional opening provided at the interior drain pipe. Thereafter, the user may perform a rotation of the cleanout cap 100 in a suitable direction by engaging a wrench (not shown) to the rectangular protrusion 100 for installing the cleanout cap 100 at the interior drain pipe. Further, the user may engage the wrench to the rectangular protrusion 160 and perform a rotation of the cleanout cap 160 in a suitable direction to uninstall the cleanout cap 100 from the interior drain pipe. The suitable direction of rotations for installing the cleanout cap 100 may be at least one of a clockwise direction of rotation, and an anti-clockwise direction of rotation. Accordingly, the suitable direction of the rotation for uninstalling the cleanout cap 100 may be selected.

Further, as described herein, the responsive elements 200*a* and 200*b* are configured to the cleanout cap 100 for sensing the clog deposition at the portion of the interior drain pipe, where the cleanout cap 100 is installed at the interior drain pipe. The responsive elements 200*a* and 200*b* are spaced apart at a predetermined distance, as desired, and are adapted to extend from a front portion of the cleanout cap 100 to the bottom portion 170 thereof. Specifically, referring to FIGS. 2A and 2B, the responsive elements 200*a* and 200*b* extend from the circular space 130 to the bottom portion 170 adjacent to opposite sides of the rectangular protrusion 160 of the cleanout cap 100. Accordingly, the predetermined distance between the responsive elements 200*a* and 200*b* is based on a separation between the opposite sides of the rectangular protrusion 160. Further, the responsive elements 200*a* and 200*b* extend from the circular space 130 in such a manner that respective portions thereof are exposed in the circular space 130. According to one embodiment of the present invention, the responsive elements 200*a* and 200*b* are monitor probes formed from materials, such as metals, or other conductive materials. According to another embodiment of the present invention, the responsive elements 200*a* and 200*b* are stainless steel probes, each having a rubber gasket member (not shown) for providing encasing to respective responsive elements, such as the responsive elements 200*a* and 200*b*. Such encasing provides water and vapor tight sealing to the responsive elements 200*a* and 200*b*.

Referring particularly to FIG. 1, the alarming module 300 is electrically coupled to the at least one drain blockage responsive element, such as the responsive elements 200*a* and 200*b*. More particularly, the alarming module 300 is electrically coupled to the responsive elements 200*a* and 200*b* through at least one bell wire, such as bell wires 400*a* and 400*b*, hereinafter referred to as 'bell wires 400*a* and 400*b*'. The bell wires 400*a* and 400*b* are electrically coupled to the respective responsive elements 200*a* and 200*b* (shown in FIG. 2A), and extend therefrom to couple with the alarming module 300. Without departing from the scope of the present invention, the bell wires 400*a* and 400*b* may be 18/2 bell wires of a suitable length. The alarming module 300 may be secured to an interior wall portion (not shown) of the residential and/or the commercial building, whereby the inhabitants thereof may have easy access thereto. According to one embodiment of the present invention, the alarming module 300 may be supported at the interior wall portion by means of nails (not shown) protruding from the interior wall portion.

Further, for powering the alarm system 1000, in one embodiment of the present invention, the alarming module 300, and the responsive elements 200*a* and 200*b* may be powered by a Direct Current (DC) power of about 9 volts to about 12 volts. In another embodiment of the present invention, the alarming module 300, and the responsive elements 200*a* and 200*b* may receive a line power of about 110 to about 120 Volts that is stepped down by a suitable transformer to about 9 volts to about 12 volts. Further, in yet another embodiment of the present invention, the alarm system 1000, and the responsive elements 200*a* and 200*b* may be powered by at least one battery. In the described embodiment, a battery assembly module (not shown) having at least one battery therein may be coupled to the alarm system 1000.

The alarm system 1000 is capable of providing an alarm indication under incipient blockage conditions to make the inhabitants aware of a possibility of a blockage condition in the sewerdrain. More particularly, when the cleanout cap 100 is secured to the interior drain pipe, as described above, the circular space 130 is in contact with water and the clog. Further, the responsive elements 200*a* and 200*b*, which extends from the circular space 130 sense the clog deposition and generates an output signal. The output signal is provided to the alarming module 300, electrically coupled to the responsive elements 200*a* and 200*b*, through the bell wires 400*a* and 400*b*. The alarming module 300 receives the output signal, and generates an alarm signal.

The alarm signal may be at least one of an audible alarm signal, a visual alarm signal, and, a combination thereof. According to one embodiment of the present invention, the alarming module 300 includes a light flasher 310 for generating the visual alarm signal. However, it will be evident to a person skilled in the art to have a light bulb, and the like generating the visual alarm signal. According to another embodiment of the present invention, the alarming module 300 includes a bell for generating an audible alarm signal. However, it will be evident to a person skilled in the art to have a buzzer, and the like for generating an audible alarm signal. Further, the alarming module 300 includes a reset button 320 configured to a top portion of the alarming module 300. The reset button 320 may be operated by the inhabitants to reset the alarming module 300. The reset button 320 may also be operated by the inhabitants to mute the audible alarm signal. The alarm signal cautions the inhabitants of a possibility of a blockage condition in the sewerdrainage, thereby enabling the inhabitants to take a preventive action required to remove the clog deposition that may cause the blockage condition. According to an embodiment of the present invention, the alarm signal may be adapted to automatically stop after a predetermined time period, as fixed by the inhabitants.

The alarm system 1000 bears simple, dependable and economical design, and, may be readily installed by a user or the inhabitants of the residential and/or the commercial building in the interior drain pipe thereof. The installation of the alarm system 1000 does not require any modification of the existing sewerdrain. Further, the alarm system 1000 may be installed by performing simple steps, without requiring involvement of skilled plumbers and/or electricians or other artisans and without investing comparatively large monetary amounts associated therewith. In use, a user may remove an existing cleanout cap of the interior drain pipe by utilizing simple home tool, such as a wrench. Thereafter, the cleanout cap 100 may be installed at the interior drain pipe by mating the threads 150 of the cleanout cap 100 with the corresponding threads formed in the conventional opening provided at the interior drain pipe of the sewer drainage. The cleanout cap 100 may be tightened by using the wrench, as described above, thereby securely installing the cleanout cap 100 at the interior drain pipe. Thereafter, the alarming module 300 may be secured at a desired position of the interior wall portion of the residential and/or the commercial building. The length of the bell wires 400*a* and 400*b* is sufficient enough to allow the alarming module 300 to be secured at the desired position of the interior wall portion. Thereafter, the alarm module 300 may be provided power for operation thereof.

The alarm system 100, as described herein, provides an advance warning to the inhabitants under incipient blockage conditions of a sewerdrain. Upon receiving the advance warning, in form of at least one of the audible alarm signal, the visual alarm signal and the combination thereof, the inhabitants may take preventive actions before the acute stage of blockage occurs in the sewerdrain.

A drain blockage responsive alarm system, such as the alarm system 1000 of the present invention offers the following advantages. The drain blockage responsive alarm system may be readily installed in interior piping systems of existing sewerdrains of a residential and/or a commercial building to provide an advance warning under incipient blockage conditions of a sewerdrain. Further, the drain blockage responsive alarm system may be readily installed in the sewerdrain without the requirement of additional building materials or piping modification of the sewerdrain. The drain blockage responsive alarm system may be readily installed in the sewer drainage without requiring skilled plumbers and/or electricians or other artisans, thereby avoiding comparatively large monetary amounts associate with such installations. Furthermore, the drain blockage responsive alarm system bears simple, dependable, and economical design.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention.

What is claimed is:

1. A drain blockage response alarm system comprising:

a cleanout cap member installed at a portion of a drain pipe;

a circular space on the cleanout cap member, where the circular space is defined by a circular protrusion extending from a periphery of the cleanout cap member;

a bottom portion of the cleanout cap member, where the bottom portion opposes the circular space;

a rectangular protrusion extending from the bottom portion of the cleanout cap member, where the rectangular protrusion facilitates a user to install the cleanout cap to the portion of a drain pipe;

at least one drain blockage responsive element configured to the cleanout cap member adapted to sense clog deposition at the portion of the drain pipe, and to generate an output signal upon sensing the clog deposition, where the at least one drain blockage responsive element is positioned adjacent to the rectangular protrusion and where the at least one drain blockage responsive element extends from the circular space to the bottom portion; and an alarming module electrically coupled to the at least one drain blockage responsive element, wherein the alarming module generates an alarm signal upon receiving the output signal.

2. The drain blockage responsive alarm system of claim 1, wherein the alarming module is electrically coupled to the at least one drain blockage responsive element through at least one bell wire.

3. The drain blockage responsive alarm system of claim 1, wherein the alarm module is powered electrically.

4. The drain blockage responsive alarm system of claim 1, wherein the alarm signal is at least one of an audible alarm signal, a visual alarm signal, and, a combination thereof.

5. The drain blockage responsive alarm system of claim 1, wherein a portion of the at least one of the drain blockage responsive elements is exposed in the circular space.

6. The drain blockage response alarm system of claim 1, wherein the alarm system is powered by at least one battery.

7. The drain blockage responsive alarm system of claim 1, wherein the alarming module includes a reset button to reset the alarming module.

8. The drain blockage responsive alarm system of claim 1, wherein the alarm signal stops after a predetermined time period.

* * * * *